US009684280B2

(12) United States Patent
Arata

(10) Patent No.: US 9,684,280 B2
(45) Date of Patent: Jun. 20, 2017

(54) COOLING DEVICE INCLUDING AIR BLOWER, AND IMAGE FORMING APPARATUS INCLUDING COOLING DEVICE

(71) Applicant: KYOCERA Document Solutions Inc., Osaka-shi, Osaka (JP)

(72) Inventor: Tatsuro Arata, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/188,790

(22) Filed: Jun. 21, 2016

(65) Prior Publication Data

US 2016/0378059 A1 Dec. 29, 2016

(30) Foreign Application Priority Data

Jun. 29, 2015 (JP) ..... 2015-129681

(51) Int. Cl.
*G03G 21/20* (2006.01)

(52) U.S. Cl.
CPC ... *G03G 21/206* (2013.01); *G03G 2215/0132* (2013.01); *G03G 2221/1645* (2013.01)

(58) Field of Classification Search
CPC ..... G03G 21/206
USPC ..... 399/92
See application file for complete search history.

(56) References Cited

U.S. PATENT DOCUMENTS 6,356,722 B1 * 3/2002 Kida ..... G03G 21/206 399/92
8,934,806 B2 * 1/2015 Koyama ..... G03G 21/206 399/92
9,086,680 B2 * 7/2015 Takahashi ..... G03G 21/206
9,158,276 B2 * 10/2015 Konishi ..... G03G 21/206

FOREIGN PATENT DOCUMENTS

JP 2003223092 A 8/2003

* cited by examiner

*Primary Examiner* — William J Royer
(74) *Attorney, Agent, or Firm* — Alleman Hall Creasman & Tuttle LLP

(57) ABSTRACT

A cooling device includes an air blower, a first support frame, and a second support frame. The first support frame supports the air blower and has a first groove portion extending from a blowing port of the air blower to a predetermined discharge port. The second support frame supports a driving portion for transmitting a driving force to a portion to be driven of an image forming apparatus, and is configured such that the first support frame is connectable thereto. The second support frame has a second groove portion. The second groove portion is engaged with the first groove portion, in a state where the first support frame is connected to the second support frame, to form an air duct configured to guide air blown from the air blower, to the discharge port.

11 Claims, 9 Drawing Sheets

COOLING DEVICE INCLUDING AIR BLOWER, AND IMAGE FORMING APPARATUS INCLUDING COOLING DEVICE

INCORPORATION BY REFERENCE

This application is based upon and claims the benefit of priority from the corresponding Japanese Patent Application No. 2015-129681 filed on Jun. 29, 2015, the entire contents of which are incorporated herein by reference.

BACKGROUND

The present disclosure relates to a cooling device for sending air to cool an object to be cooled, and an image forming apparatus including the cooling device.

An image forming apparatus which forms an image on a sheet member, such as a copy machine and a printer, is known. Within such a type of image forming apparatus, various members that become heat sources are provided. Examples of such members include a heating device for melting toner, and a motor for driving a roller or the like. Due to these heat sources, the temperature within the image forming apparatus increases. The increase in the temperature within the image forming apparatus causes, for example, a decrease in the flowability of a developer such as toner, a decrease in an electric charge amount of the developer, or a variation in a sheet conveyance speed due to expansion of a roller, resulting in an image defect. Thus, hitherto, in the image forming apparatus, a cooling device for sending air to the interior of the image forming apparatus to cool the interior is provided. The conventional cooling device includes an air duct for passing air blown from an air blower, and the air is sent from the air duct toward an object to be cooled, thereby cooling the object.

SUMMARY

A cooling device according to one aspect of the present disclosure includes an air blower, a first support frame, and a second support frame. The first support frame supports the air blower and has a first groove portion extending from a blowing port of the air blower to a predetermined discharge port. The second support frame supports a driving portion for transmitting a driving force to a portion to be driven of the image forming apparatus, and is configured such that the first support frame is connectable thereto. The second support frame has a second groove portion. The second groove portion is engaged with the first groove portion, in a state where the first support frame is connected to the second support frame, to form an air duct configured to guide air blown from the air blower, to the discharge port.

An image forming apparatus according to another aspect of the present disclosure includes the cooling device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
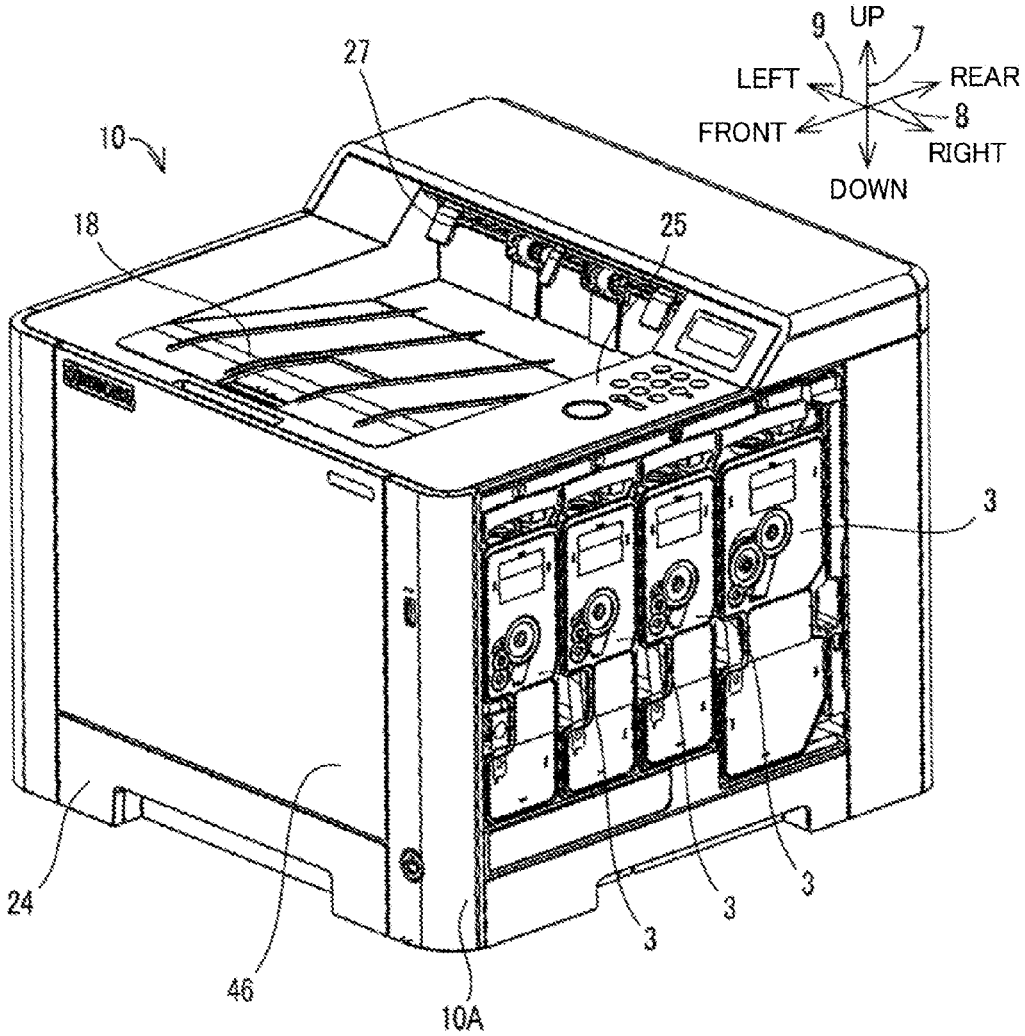
FIG. 1 is a right side perspective view showing the configuration of an image forming apparatus according to an embodiment of the present disclosure.

Hereinafter, an embodiment of the present disclosure will be described with reference to the drawings as appropriate. It should be noted that the embodiment described below is merely an example embodying the present disclosure and does not limit the technical scope of the present disclosure. For convenience of explanation, in an installation state where an image forming apparatus 10 is usable (a state shown in FIG. 1), the vertical direction is defined as an up-down direction 7. In addition, a front-rear direction 8 is defined with, as a front face (front surface), a surface through which a sheet feed cassette 24 shown in FIG. 1 is inserted/pulled out in the installation state. Moreover, a right-left direction 9 is defined on the basis of the front face of the image forming apparatus 10 in the installation state.

The image forming apparatus 10 according to the embodiment of the present disclosure is, for example, a tandem-type color printer. The image forming apparatus 10 prints an image on a sheet-like print paper (sheet member) by using a developer that contains toner.

Figure 2:
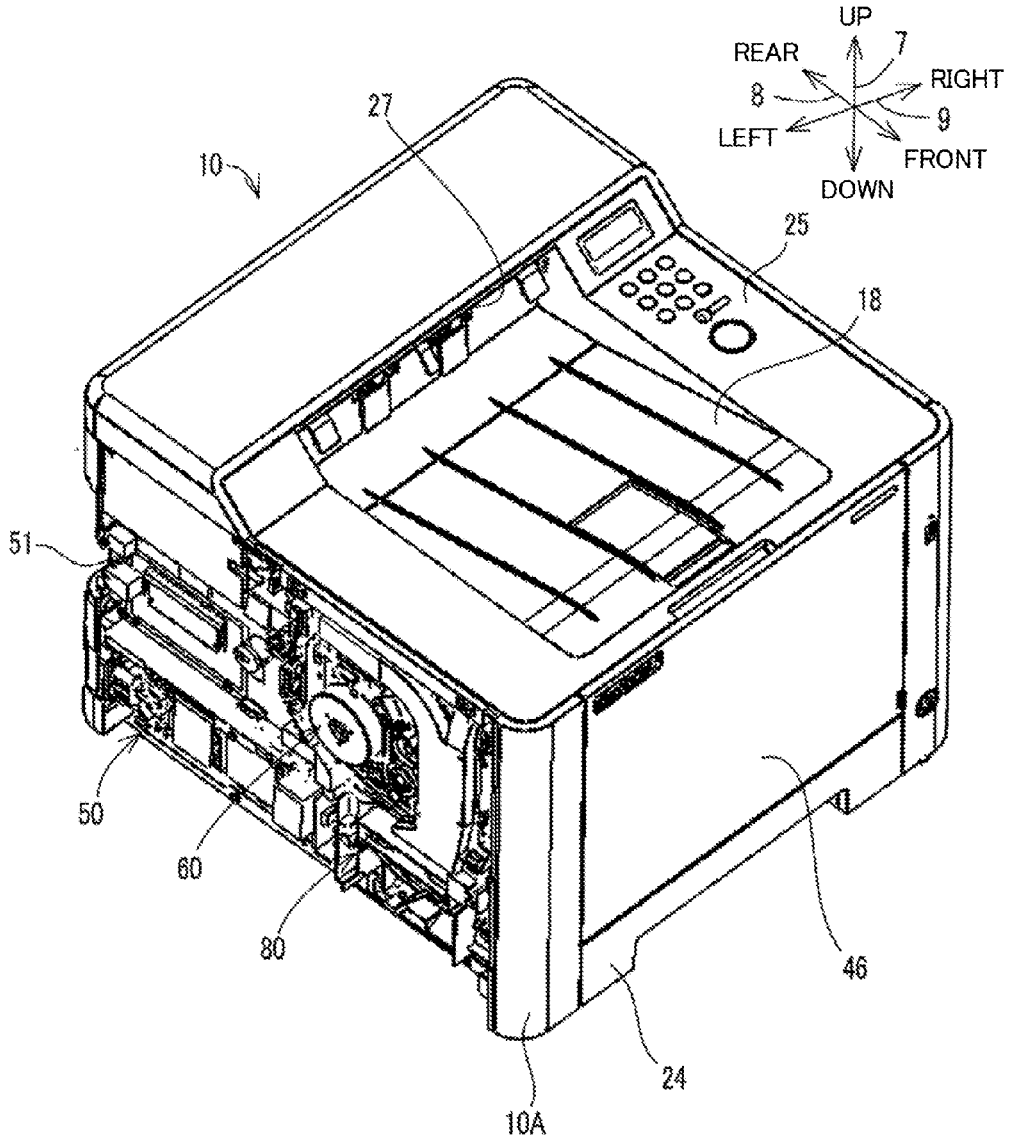
FIG. 2 is a left side perspective view showing the configuration of the image forming apparatus.

As shown in FIGS. 1 and 2, the image forming apparatus 10 includes a housing 10A. The housing 10A has a substantially rectangular parallelepiped shape as a whole. Within the housing 10A, each portion forming the image forming apparatus 10 is disposed. FIG. 1 shows a state where a cover at the right side surface of the housing 10A is removed, and FIG. 2 shows a state where a cover at the left side surface of the housing 10A is removed.

Figure 3:
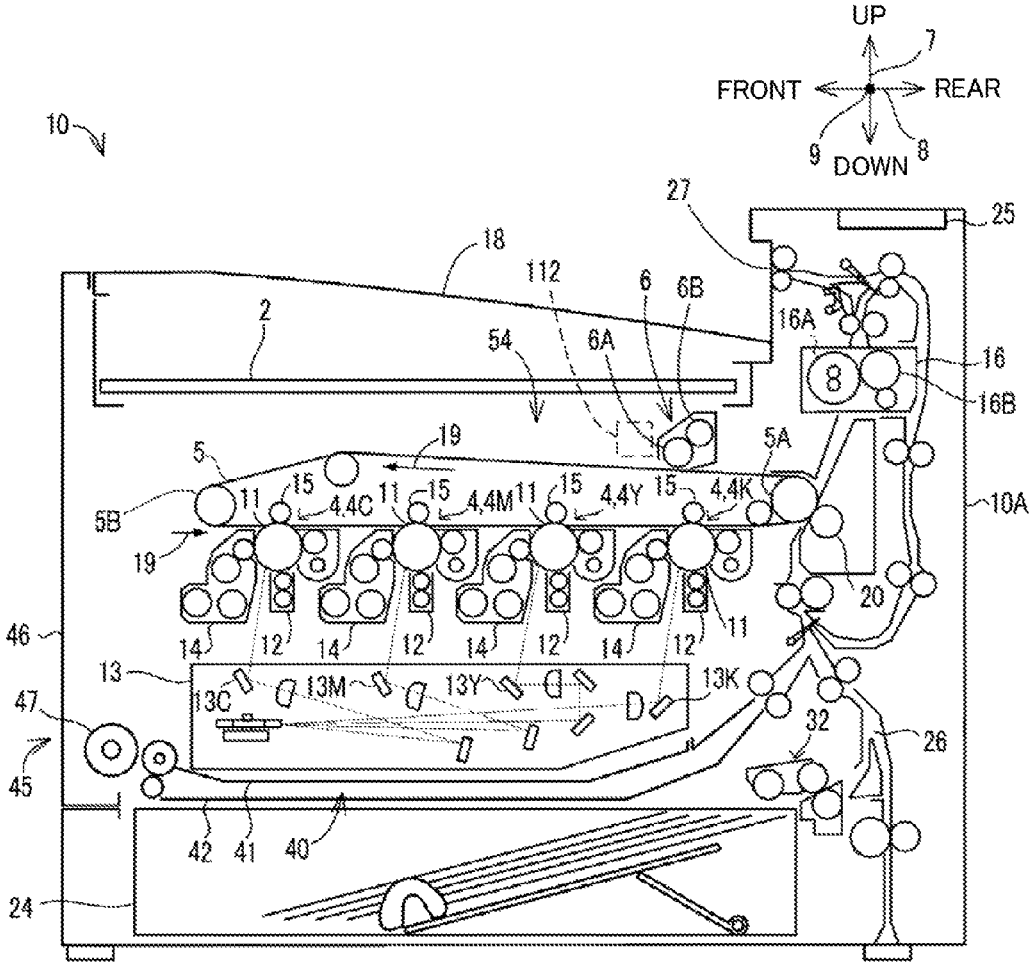
FIG. 3 is a cross-sectional view showing the configuration of the image forming apparatus.

As shown in FIG. 3, the image forming apparatus 10 includes a plurality of image forming units 4, an intermediate transfer belt 5, a laser scanning unit 13, a secondary transfer roller 20, a fixing device 16, a sheet tray 18, the sheet feed cassette 24, a sheet feed unit 32, an operation display portion 25, a vertical conveyance path 26, a belt-cleaning device 6 (an example of a waste toner cleaning portion of the present disclosure), and a control board 2. The image forming apparatus 10 forms a monochrome image or a color image on a print paper on the basis of inputted image data. The print paper is paper, coated paper, a postcard, an envelope, an OHP sheet, or the like.

Within the housing 10A, a partition plate 51 (see FIG. 2) is provided at the left side thereof so as to extend in the up-down direction 7. The partition plate 51 is an example of a mounting plate of the present disclosure. By the partition plate 51, the internal space of the housing 10A is divided into a first space 51A at the left side and a second space 51B at the right side (see FIG. 9). The respective components such as the image forming units 4, the intermediate transfer belt 5, the belt cleaning device 6, and the control board 2, which are described above, are provided in the second space 51B.

The operation display portion 25 is a touch panel or the like that displays various kinds of information in accordance with control instructions from the control board 2, and inputs various kinds of information into the control board 2 in accordance with user operations.

Each of the image forming units 4 (4C, 4M, 4Y, 4K) includes a photosensitive drum 11, a charging device 12, a developing device 14, and a primary transfer roller 15 and forms an image according to electrophotography. The image forming units 4 are arranged within the housing 10A and along the front-rear direction 8, and form a color image on the basis of a so-called tandem method. Specifically, a toner image corresponding to C (cyan) is formed in the image forming unit 4C, a toner image corresponding to M (magenta) is formed in the image forming unit 4M, a toner image corresponding to Y (yellow) is formed in the image forming unit 4Y, and a toner image corresponding to K (black) is formed in the image forming unit 4K. The image forming unit 4C for cyan, the image forming unit 4M for magenta, the image forming unit 4Y for yellow, and the image forming unit 4K for black are arranged in a line in this order from the downstream side in a direction in which the intermediate transfer belt 5 moves (the direction of an arrow 19).

In the respective image forming units 4, the photosensitive drums 11 are uniformly charged at a predetermined potential by the charging devices 12. Next, laser light is applied to the surfaces of the respective photosensitive drums 11 by the laser scanning unit 13 on the basis of image data, whereby electrostatic latent images are formed on the surfaces of the respective photosensitive drums 11. Then, the electrostatic latent images on the respective photosensitive drums 11 are developed (visualized) as toner images of the respective colors by the developing devices 14. The toner images of the respective colors formed on the photosensitive drums 11 are successively transferred in an overlaid manner onto the intermediate transfer belt 5 by the respective primary transfer rollers 15. Accordingly, a color image based on the image data is formed on the intermediate transfer belt 5. Next, the color image on the intermediate transfer belt 5 is transferred by the secondary transfer roller 20 onto a print paper conveyed from the sheet feed cassette 24 through the vertical conveyance path 26.

In the respective developing devices 14, detachable toner containers 3 corresponding to the respective colors are mounted. Toner (developer) is supplied from each toner container 3 to the corresponding developing device 14. In the present embodiment, as shown in FIG. 1, the four toner containers 3 are provided at the right side of the image forming units 4 and inward of the right side surface of the housing 10A. The respective toner containers 3 are aligned in the front-rear direction 8 at the right side of the housing 10A.

The intermediate transfer belt 5 is provided above the four image forming units 4. The intermediate transfer belt 5 is a member onto which toner images of the respective colors formed on the respective photosensitive drums 11 are intermediately transferred. The intermediate transfer belt 5 is supported by a driving roller 5A and a driven roller 5B such that the intermediate transfer belt 5 can be rotationally driven. By being supported by the driving roller 5A and the driven roller 5B, the intermediate transfer belt 5 is movable while a surface thereof is in contact with the surface of each photosensitive drum 11. When the surface of the intermediate transfer belt 5 passes between each photosensitive drum 11 and the corresponding primary transfer roller 15, a toner image is successively transferred from each photosensitive drum 11 in an overlaid manner onto the surface thereof.

The laser scanning unit 13 is provided below the four image forming units 4. The laser scanning unit 13 includes laser light sources that emit laser light of the respective colors, a polygon mirror that scans the laser light, and mirrors 13C, 13M, 13Y, and 13K that emit the scanned laser light. The laser scanning unit 13 emits the laser light to the photosensitive drum 11 of each image forming unit 4 on the basis of inputted image data for each color, thereby forming an electrostatic latent image on each photosensitive drum 11.

The sheet feed cassette 24 is provided at a bottom portion of the housing 10A. The sheet feed unit 32 takes out, one by one, print papers placed on the sheet feed cassette 24, and feeds the print papers within the sheet feed cassette 24 toward the vertical conveyance path 26.

A conveyance path 40 is formed between the laser scanning unit 13 and the sheet feed cassette 24. An upper guide member 41 and a lower guide member 42 are provided below the laser scanning unit 13. The upper guide member 41 and the lower guide member 42 are disposed so as to oppose each other in the up-down direction 7 and be spaced apart from each other at a predetermined interval. A space between the upper guide member 41 and the lower guide member 42 is the conveyance path 40. The conveyance path 40 is connected to the vertical conveyance path 26 at the rear side of the image forming apparatus 10.

At the front surface side of the image forming apparatus 10, a manual type sheet feed portion 45 is provided. The sheet feed portion 45 feeds a print paper via the conveyance path 40 and the vertical conveyance path 26 to the secondary transfer roller 20 in the image forming apparatus 10. The sheet feed portion 45 includes a sheet receiving portion 46 and a feeding portion 47. The sheet receiving portion 46 also serves as a cover for the front surface of the housing 10A of the image forming apparatus 10. The sheet receiving portion 46 is configured to be able to open/close an inlet of the conveyance path 40 with respect to the front surface of the housing 10A. FIG. 3 shows a state where the sheet receiving portion 46 is closed with respect to the front surface of the housing 10A. When the sheet receiving portion 46 is opened with respect to the front surface of the housing 10A such that the inner surface thereof faces upward, print papers having a predetermined size can be placed on the inner surface. The print papers placed on the sheet receiving portion 46 are fed to the conveyance path 40 by the feeding portion 47. On the conveyance path 40, a conveying roller pair (not shown) is provided, and the print paper in the conveyance path 40 is conveyed rearward by the conveying roller pair.

The secondary transfer roller 20 is provided at the rear side of the housing 10A and at a position opposing the driving roller 5A. By the secondary transfer roller 20, an image is transferred from the intermediate transfer belt 5 onto a print paper.

The fixing device 16 is provided above the secondary transfer roller 20. The fixing device 16 includes a heating roller 16A that is heated by a heating device, and a pressure roller 16B that is disposed so as to oppose the heating roller 16A. The print paper having conveyed from the secondary transfer roller 20 to the fixing device 16 is conveyed while being nipped by the heating roller 16A and the pressure roller 16B. Accordingly, a color image is fixed to the print paper.

The sheet tray 18 is provided at the upper surface of the housing 10A. The print paper having passed through the fixing device 16 is discharged through a sheet discharge port 27 to the sheet tray 18.

The belt cleaning device 6 is provided near the fixing device 16, above the intermediate transfer belt 5, and at the rear side of the housing 10A. More specifically, the belt cleaning device 6 is provided above the image forming unit 4K and in a space 54 (see FIG. 9) surrounded by the sheet tray 18 and the intermediate transfer belt 5. The belt cleaning device 6 removes waste toner remaining on the surface of the intermediate transfer belt 5 and puts the removed waste toner into a waste toner bottle (not shown). The belt cleaning device 6 includes a cleaning roller 6A that is long in the right-left direction 9, a screw member 6B that conveys waste toner, and the waste toner bottle. The cleaning roller 6A rotates in contact with the surface of the intermediate transfer belt 5 to remove waste toner therefrom The control board 2 is provided above the intermediate transfer belt 5. Specifically, the control board 2 is provided between the sheet tray 18 and the intermediate transfer belt 5. The control board 2 controls each portion of the image forming apparatus 10. The control board 2 is a plate-like board on which electronic devices such as a calculation device including a CPU and a ROM, an electrolytic capacitor, a coil, a converter (e.g., an AC/DC converter), and a transformer that steps up or down a voltage are mounted. The control board 2 is connected to each image forming unit 4, the secondary transfer roller 20, the fixing device 16, the driving roller 5A, and the sheet feed unit 32 and controls these components. When the control board 2 is energized, each electronic device thereof generates heat to be a heat source. In addition, when the control board 2 is excessively heated by heat from the fixing device 16, the control board 2 may malfunction. Thus, the control board 2 needs to be cooled.

As shown in FIG. 2, the image forming apparatus 10 further includes a power supply board 50, a driving unit 60, and a cooling device 80 according to the embodiment of the present disclosure.

In the housing 10A, the partition plate 51 is provided at the left side thereof. As described above, by the partition plate 51, the internal space of the housing 10A is divided into the first space 51A at the left side and the second space 51B at the right side with the partition plate 51 as a boundary (see FIG. 9). In the present embodiment, the power supply board 50, the driving unit 60, and the cooling device 80 are provided in the first space 51A at the left side with respect to the partition plate 51.

Figure 4:
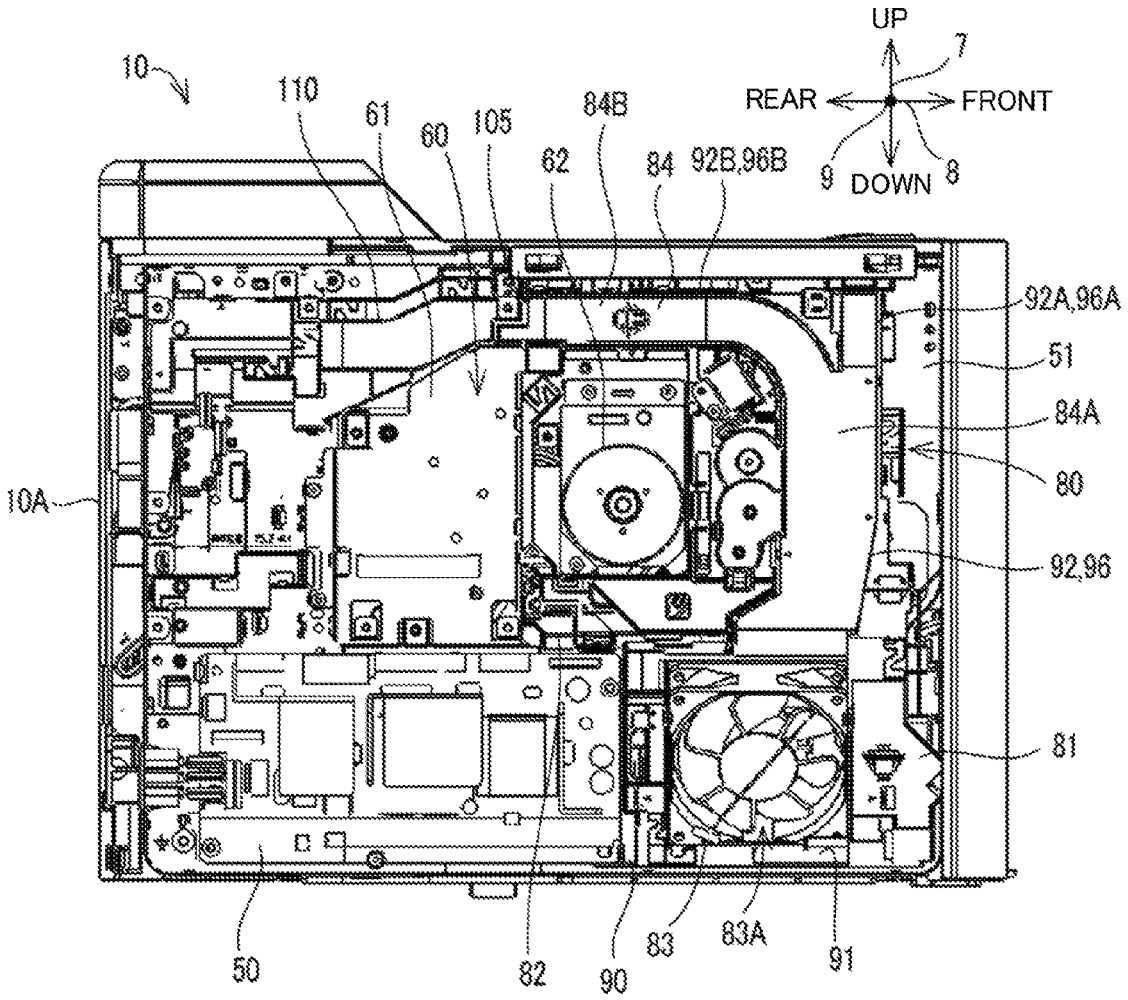
FIG. 4 is a diagram showing the internal configuration of the left side of the image forming apparatus.

As shown in FIG. 4, the power supply board 50 is provided in the first space 51A and is mounted on the left side surface of the partition plate 51. More specifically, the power supply board 50 is provided on a lower left portion of the left side surface of the partition plate 51. The power supply board 50 converts a commercial voltage into a control voltage and a driving voltage to be used in the image forming apparatus 10, and supplies the control voltage and the driving voltage to each portion of the image forming apparatus 10, and is a board on which electronic devices such as an electrolytic capacitor, a coil, a converter (e.g., an AC/DC converter), and a transformer that steps up or down a voltage are mounted. Thus, when the power supply board 50 is energized, each electronic device thereof generates heat to be a heat source, and hence the power supply board 50 needs to be cooled.

The driving unit 60 and the cooling device 80 are mounted on the left side surface of the partition plate 51 in a state where the driving unit 60 and the cooling device 80 are integrated with each other. In the present embodiment, the cooling device 80 is mounted on the driving unit 60.

Figure 5:
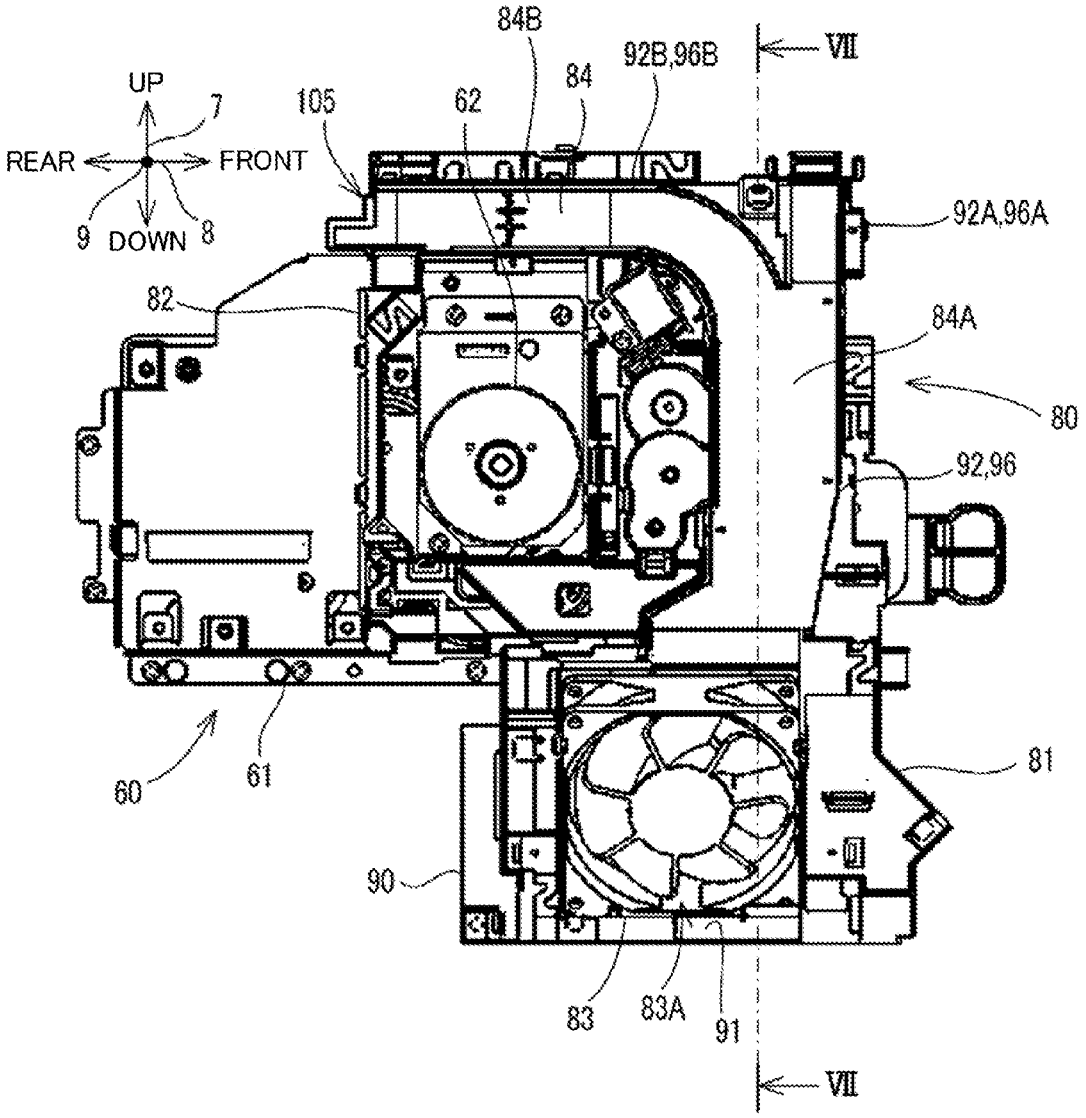
FIG. 5 is a diagram showing a driving unit and a cooling device of the image forming apparatus.
Figure 6:
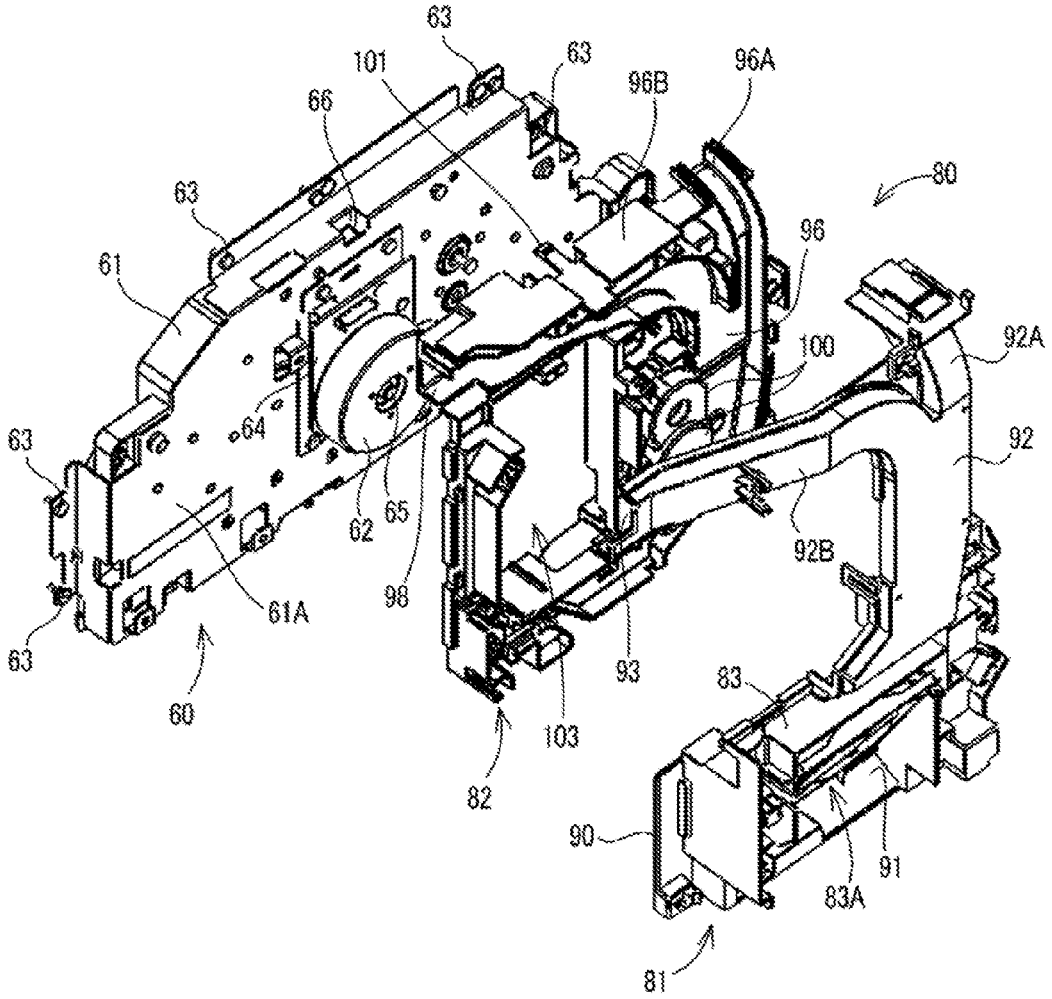
FIG. 6 is an exploded view of the cooling device.

FIG. 5 is a diagram showing the driving unit 60 and the cooling device 80. FIG. 6 is an exploded view of the driving unit 60 and the cooling device 80. As shown in FIGS. 5 and 6, the driving unit 60 includes a sheet metal frame 61 (an example of a third support frame of the present disclosure) formed from a sheet metal, and a motor 62. The sheet metal frame 61 has through holes 63 formed in an outer periphery thereof as appropriate. The sheet metal frame 61 is fixed to the left side surface (mounting surface) of the partition plate 51 by means of screws using the through holes 63. The sheet metal frame 61 is mounted at the center of an upper portion of the partition plate 51.

The motor 62 is supported by the sheet metal frame 61. The motor 62 is fixed at substantially the center of the sheet metal frame 61 via a bracket 64 by means of screws or the like. An output shaft 65 of the motor 62 is exposed to the second space 51B from a through opening (not shown) formed in the partition plate 51. A drive transmission mechanism such as a gear is connected to the output shaft 65. In order to transmit a rotational driving force of the motor 62 to portions to be driven such as the photosensitive drums 11, a developing roller, and the driving roller 5A of the intermediate transfer belt 5, the drive transmission mechanism is connected to each portion to be driven. An electromagnetic clutch or the like is provided between the drive transmission mechanism and each portion to be driven, and drive transmission to each portion to be driven is controlled by the electromagnetic clutch being controlled as appropriate.

A second resin frame 82 of the cooling device 80 is mounted on the sheet metal frame 61. The cooling device 80 is mounted on the left side surface of the partition plate 51 via the sheet metal frame 61. The second resin frame 82 is mounted on a support surface 61A of the sheet metal frame 61 on which the motor 62 is mounted. Specifically, as shown in FIG. 6, an engagement hole 66 is provided at the periphery of the support surface 61A of the sheet metal frame 61, and a projection piece 101 having a distal end with a hook shape is provided to the second resin frame 82. The projection piece 101 is engaged with the engagement hole 66 by means of snap fit by being inserted into the engagement hole 66. Accordingly, the second resin frame 82 is mounted on the support surface 61A of the sheet metal frame 61. FIG. 6 shows one set of the engagement hole 66 and the projection piece 101, but a plurality of sets thereof are provided. The mounting mechanism for the sheet metal frame 61 and the second resin frame 82 is not limited to the above snap fit, and a fixing tool such as a screw may be used.

The cooling device 80 includes a first resin frame 81 (an example of a first support frame of the present disclosure), the second resin frame 82 (an example of a second support frame of the present disclosure), a blower fan 83 (an example of an air blower of the present disclosure), and an air duct 84. The air duct 84 guides air sent by the blower fan 83.

In a conventional cooling device, the air duct is configured as a member separate from the housing of the cooling device, so that a space for disposing the air duct has to be ensured within the housing 10A. In this configuration, compacting of the image forming apparatus 10 is inhibited.

In addition, in the conventional configuration, in the case of disposing the air duct in a limited space, the capacity of the air duct has to be reduced, so that a sufficient air volume required for cooling cannot be supplied in some cases. In addition, in the case of disposing the air duct in a limited space, even when a sufficient capacity is ensured, the flexibility in designing is low. Thus, when the air duct resonates along with driving of the blower fan 83, geometric design for avoiding the resonance frequency is difficult. On the other hand, in the present embodiment, the air duct 84 is formed by a later-described first groove portion 92 provided in the first resin frame 81 and a later-described second groove portion 96 provided in the second resin frame 82. Accordingly, it is possible to save a space for disposing the air duct 84 while the capacity of the air duct 84 of the cooling device 80 is sufficiently ensured. Hereinafter, the configuration of the cooling device 80 will be described in detail.

Figure 7:
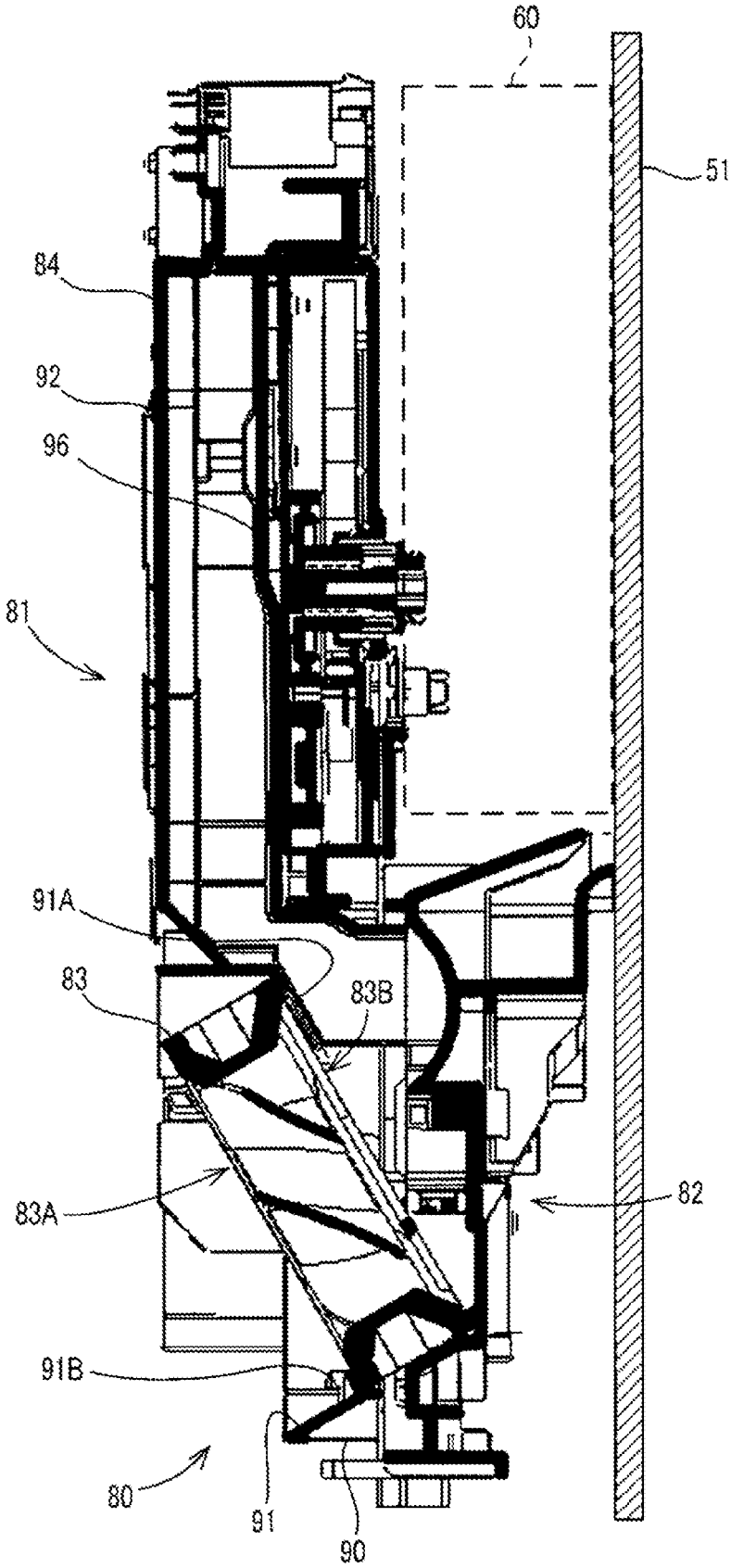
FIG. 7 is a cross-sectional view taken along a line VII-VII in FIG. 5.

When the blower fan 83 is driven, the blower fan 83 sucks air through a suction port 83A and blows the air through a blowing port 83B (FIG. 7) to send the air. The blower fan 83 is, for example, an axial-flow fan. As a matter of course, an air blower of a type different from an axial-flow fan may be used. The blower fan 83 is mounted on the first resin frame 81.

The first resin frame 81 is obtained by molding a synthetic resin. The first resin frame 81 is connected to the later-described second resin frame 82 and used. As shown in FIG. 6, the first resin frame 81 includes a substantially rectangular fan-mounting portion 90 and the first groove portion 92. A mounting seat 91 is provided in the fan-mounting portion 90, and the blower fan 83 is mounted on the mounting seat 91. A lower end 91B (FIG. 7) of the mounting seat 91 is located at the depth side (the right side in FIG. 6) with respect to an upper end 91A (FIG. 7) of the mounting seat 91. Thus, when the blower fan 83 is mounted on the mounting seat 91, the air blown by the blower fan 83 is sent obliquely upward.

The first groove portion 92 extends upward from the right side of an upper portion of the mounting seat 91, and an upper end portion thereof branches into two sections. A branch passage 92A that is one of the sections extends upward and curves to the right side of the housing 10A (the depth side of the sheet surface in FIG. 5). A branch passage 92B that is the other of the sections curves to the rear side of the housing 10A (the left side of the sheet surface in FIG. 5) and extends horizontally. The extending end of the branch passage 92B is not closed and forms an opening 93 opened rearward. The first groove portion 92 is a recessed groove formed on the back surface of the first resin frame 81. That is, the first groove portion 92 extends in the first resin frame 81 from the blowing port 83B of the blower fan 83 to the opening 93 at the extending end of the branch passage 92B.

Figure 8:
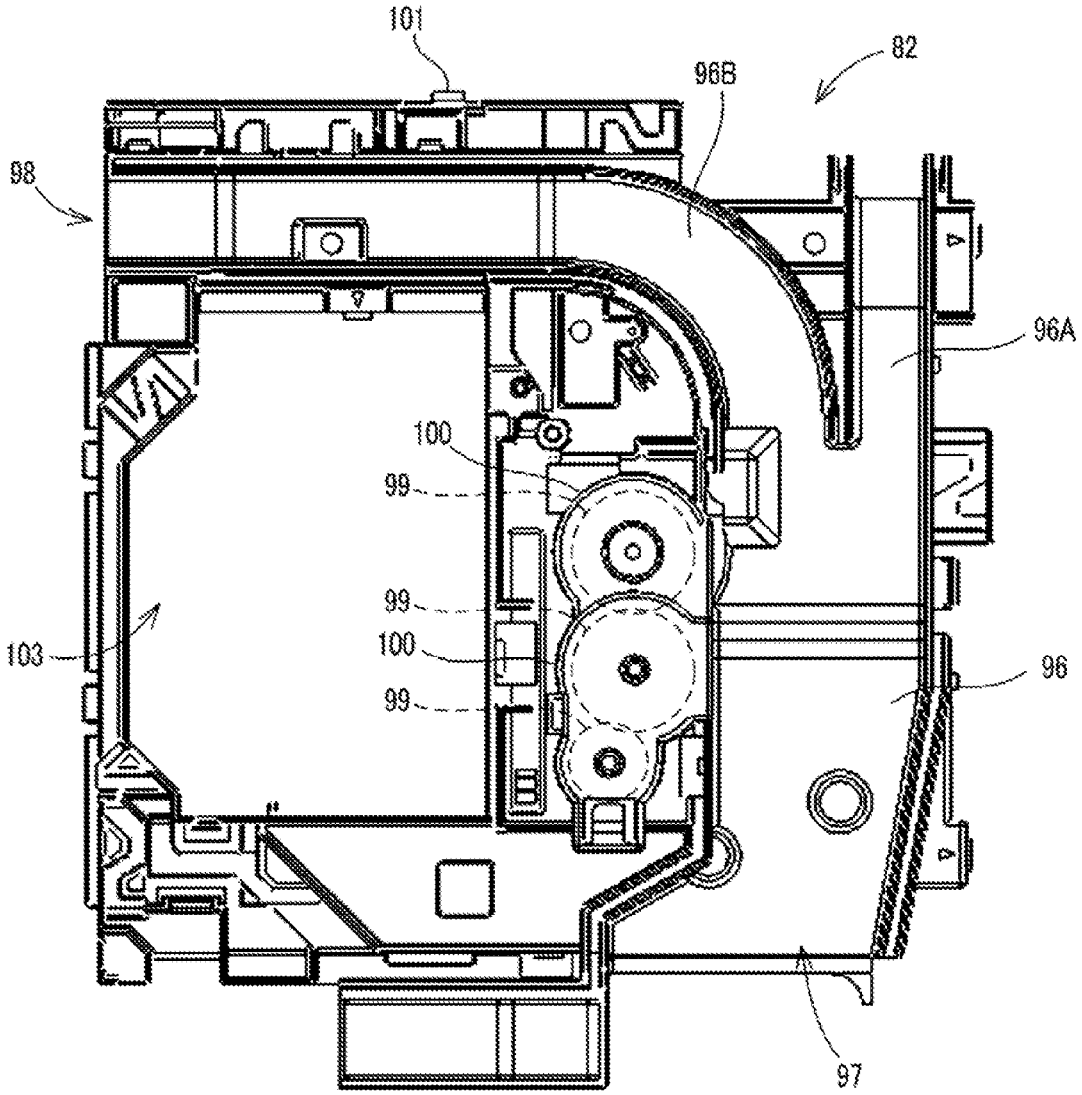
FIG. 8 is a diagram showing a second resin frame of the cooling device.

Similalry to the first resin frame 81, the second resin frame 82 is obtained by molding a synthetic resin. As shown in FIGS. 6 and 8, the second resin frame 82 includes the second groove portion 96 covered with the first groove portion 92. The second groove portion 96 is a recessed groove formed on the front surface of the second resin frame 82, and is formed in substantially the same shape as the first groove portion 92. Specifically, the lower end of the second groove portion 96 is not closed and forms an opening 97 opened downward. The opening 97 is located at the lower end of the second resin frame 82. The second groove portion 96 extends upward from the opening 97, and an upper end portion thereof branches into two sections. A branch passage 96A that is one of the sections extends upward and curves to the right side of the housing 10A (the depth side of the sheet surface in FIG. 8). A branch passage 96B that is the other of the sections curves to the rear side of the housing 10A (the left side of the sheet surface in FIG. 8) and extends horizontally. The extending end of the branch passage 96B is not closed and forms an opening 98 opened rearward. The opening 98 is located at the rear end of the second resin frame 82 (in an end portion at the left side of the sheet surface of FIG. 8).

The projection piece 101, which is engaged with the engagement hole 66 of the sheet metal frame 61, is provided to the second resin frame 82. The distal end of the projection piece 101 is formed in a hook shape. The projection piece 101 is engaged with the engagement hole 66 by means of snap fit by being inserted into the engagement hole 66, so that the second resin frame 82 is mounted on the support surface 61A of the sheet metal frame 61.

In the second resin frame 82, various transmission gears 99 (an example of a driving portion of the present disclosure) for transmitting a driving force to the portions to be driven of the image forming apparatus 10. Each transmission gear 99 is housed in a gear housing portion 100 formed in the second resin frame 82. The gear housing portion 100 is a recessed portion formed on the back surface of the second resin frame 82. The transmission gears 99 are rotatably supported by the gear housing portion 100 at the back surface side of the second resin frame 82. In a state where the second resin frame 82 is mounted on the support surface 61A of the sheet metal frame 61, each transmission gear 99 transmits the driving force of the motor 62 by a transmission mechanism that is not shown. In addition, in this mounted state, a support shaft of each transmission gear 99 project to the second space 51B through a through hole (not shown) of the partition plate 51. In the second space 51B, a rotational force of the support shaft is transmitted to the portions to be driven such as the photosensitive drums 11 by the drive transmission mechanism that is not shown. In the second resin frame 82, a driving portion such as another motor or an electromagnetic solenoid that transmits a driving force to the portions to be driven, may be provided in addition to the transmission gears 99.

As shown in FIG. 8, the gear housing portion 100 is provided adjacent to the second groove portion 96. Specifically, the gear housing portion 100 is provided adjacent to the second groove portion 96 and at the rear side with respect to the second groove portion 96. That is, the transmission gears 99 within the gear housing portion 100 are provided adjacent to the second groove portion 96. Thus, even when the transmission gears 99 are driven so that frictional heat occurs, the transmission gears 99 are cooled by the air passing through the air duct 84.

In addition, a through opening 103 is formed in the second resin frame 82. The through opening 103 is formed at the left side of the second resin frame 82. The through opening 103 penetrates the second resin frame 82. As shown in FIG. 5, when the second resin frame 82 is mounted on the sheet metal frame 61, the motor 62 is inserted through the through opening 103 and exposed on the front surface (connection surface to which the first resin frame 81 is connected) of the second resin frame 82. That is, the through opening 103 is a hole for exposing the motor 62 on the front surface of the second resin frame 82. The through opening 103 is provided adjacent to the second groove portion 96. Specifically, the through opening 103 is provided adjacent to the lower side of the branch passage 96B of the second groove portion 96.

The second resin frame 82 is configured such that the first resin frame 81 is connectable thereto. The first resin frame 81 is configured to be connectable to the front surface (the surface opposite to the surface mounted on the sheet metal frame 61) of the second resin frame 82. Specifically, side walls of the first groove portion 92 are engaged with side walls of the second groove portion 96 so as to sandwich the side walls of the second groove portion 96 from the outer side, whereby the first groove portion 92 and the second groove portion 96 are connected to each other. In addition, an engagement piece (not shown) provided at the outer periphery of the fan-mounting portion 90 as appropriate and an engagement hole (not shown) provided at the outer periphery of the second resin frame 82 are engaged with each other, whereby the first resin frame 81 and the second resin frame 82 are more firmly connected to each other. In a state where the first resin frame 81 is connected to the second resin frame 82 as described above, when the first groove portion 92 and the second groove portion 96 are positioned and engaged with each other, the air duct 84 is formed by the first groove portion 92 and the second groove portion 96. One side of the air duct 84 is connected to the blowing port 83B of the blower fan 83. The other side of the air duct 84 becomes an exhaust port 105 formed by the opening 93 and the opening 98. By the air duct 84, the air blown from the blowing port 83B of the blower fan 83 is guided to the exhaust port 105.

As shown in FIG. 4, the air duct 84 includes a first air passage 84A extending upward from the blowing port 83B of the blower fan 83, and a second air passage 84B extending horizontally from an upper end portion of the first air passage 84A to the rear side. The through opening 103 is provided below the branch passage 96B of the second groove portion 96 forming the second air passage 84B. Thus, the motor 62 exposed from the through opening 103 is disposed at a position adjacent to the lower side of the second air passage 84B. Thus, heat transmitted from the motor 62 to the branch passage 96B is cooled by the air passing through the second air passage 84B.

In the cooling device 80, the blower fan 83 is driven constantly or at required timing. Since the cooling device 80 cools the image forming units 4, the belt cleaning device 6, and the control board 2, the cooling device 80 is controlled to be driven, for example, during a period when there is concern for an increase in the temperature of each of these components, specifically, during a period from start of image formation to end of the image formation, or during a period from start of image formation to elapse of a predetermined time period after end of the image formation.

Figure 9:
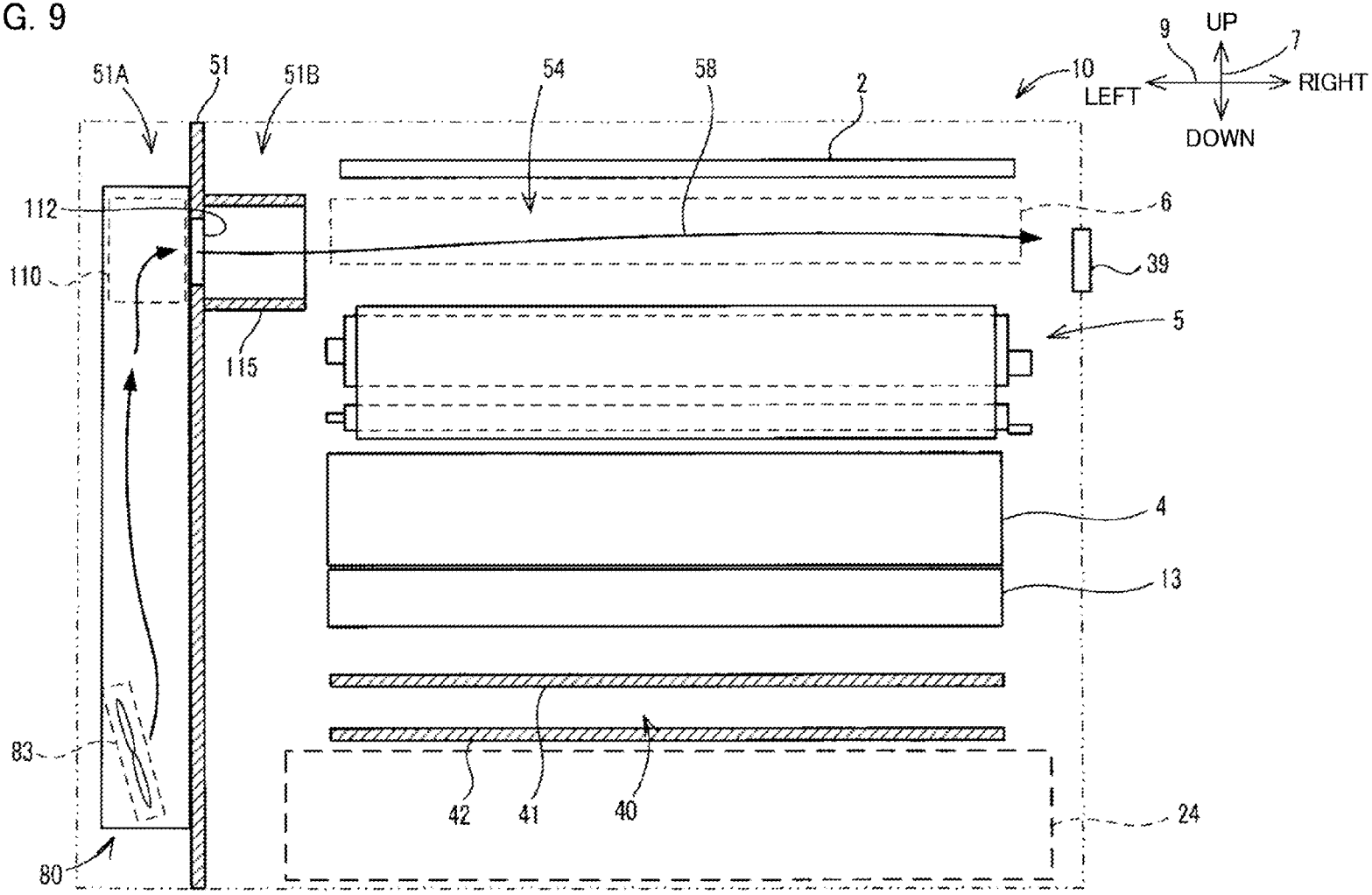
FIG. 9 is a diagram showing flow of air in the interior of the image forming apparatus.

As shown in FIG. 4, an extension duct 110 is provided at the partition plate 51 so as to be connected to the exhaust port 105 of the air duct 84. The extension duct 110 extends rearward from the exhaust port 105. The rear end of the extension duct 110 is closed. A through hole is formed in a surface, at the partition plate 51 side, of a rear end portion of the extension duct 110. This through hole is hermetically connected to a communication port 112 formed in the partition plate 51. In the present embodiment, as shown in FIG. 9, the communication port 112 is formed at substantially the same position in the up-down direction 7 and the front-rear direction 8 as the belt cleaning device 6. Specifically, the communication port 112 is formed at a position slightly frontward of the belt cleaning device 6.

As shown in FIG. 9, an air guide 115 is provided in the second space 51B. The air guide 115 guides the air conveyed from the extension duct 110 through the communication port 112, to the second space 51B. The air guide 115 is a tubular member having an inner hole that allows air to pass therethrough, one side of the inner hole is connected to the communication port 112, and the other side (air discharge side) of the inner hole is directed to the space 54 between the intermediate transfer belt 5 and the control board 2. Accordingly, the air blown from the air duct 84 of the cooling device 80 is sent through the extension duct 110 and the communication port 112 to the second space 51B, and is further guided by the air guide 115 to the space 54 between the intermediate transfer belt 5 and the control board 2. Particularly, since the communication port 112 is formed at substantially the same position in the up-down direction 7 and the front-rear direction 8 as the belt cleaning device 6, the air guide 115 can send the air toward the belt cleaning device 6, more specifically, toward above the intermediate transfer belt 5 immediately after cleaning.

As shown in FIG. 9, when the blower fan 83 is driven, the air in the first space 51A is sucked and blown through the air duct 84, the extension duct 110, the communication port 112, and the air guide 115 to the second space 51B. The air guide 115 is positioned such that the air is sent therefrom to the space 54. Thus, the air blown from the air guide 115 flows through the space 54 in the direction of an arrow 58. Then, the air is discharged to the outside through an exhaust port 39 provided in the right side surface of the image forming apparatus 10.

Since the air in the first space 51A is sucked by the blower fan 83 as described above, the pressure in the first space 51A becomes negative due to the air around the power supply board 50 being sucked, so that outside air enters the first space 51A through a gap in the housing 10A. Accordingly, the power supply board 50 is cooled. In addition the air blown to the space 54 moves rightward in the space 54, serving as an air flow passage, along the arrow 58. During the movement of the air, the air comes into contact with the back surface of the control board 2 to cool the control board 2. Similarly, the upper surface of the intermediate transfer belt 5 and the belt cleaning device 6 are cooled. Moreover, by the air flowing through the space 54, slight toner remaining on the intermediate transfer belt 5 immediately after cleaning is blown up and discharged together with the air to the outside through the exhaust port 39.

In the present embodiment, since the air duct 84 is formed by connecting the first resin frame 81 and the second resin frame 82 as described above, it is not necessary to independently provide a separate duct member as in the conventional art. Thus, within the housing 10A, the capacity of the air duct 84 can be sufficiently ensured. In addition, since a space for disposing the air duct 84 can be saved, the size of the image forming apparatus 10 can be reduced.

By the air passing through the air duct 84, heat around driving portions such as the motor 62 and the transmission gears 99 is exchanged and cooled. Accordingly, the driving unit 60 and the driving portions supported by the second resin frame 82 can be effectively cooled.

In the above embodiment, the configuration has been described in which the air in the first space 51A is sucked and sent to the second space 51B. However, the present disclosure is not limited to this configuration. In the above configuration, the air around the power supply board 50 is warmed by the power supply board 50, and thus the effect of cooling an object to be cooled in the second space 51B may be diminished when this air is used. Thus, the cooling device 80 may be provided so as to suck outside air and blow the air through the air duct 84 to the second space 51B. In addition, in the above embodiment, the configuration has been described in which air is discharged through the exhaust port 39. However, for example, air may be sucked through the exhaust port 39, caused to flow into the space 54, and discharged through the air guide 115, the extension duct 110, and the air duct 84 from the second space 51B to the first space 51A.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A cooling device comprising:

an air blower;

a first support frame supporting the air blower and having a first groove portion extending from a blowing port of the air blower to a predetermined discharge port; and a second support frame supporting a driving portion for transmitting a driving force to a portion to be driven of an image forming apparatus, the second support frame being configured such that the first support frame is connectable thereto, the second support frame having a second groove portion that is engaged with the first groove portion, in a state where the first support frame is connected to the second support frame, to form an air duct configured to guide air blown from the air blower, to the discharge port.

2. The cooling device according to claim 1, further comprising a third support frame supporting a motor configured to supply a driving force to the portion to be driven, wherein the second support frame is configured to be mountable on a support surface of the third support frame on which the motor is supported, and the first support frame is configured so as to be connectable to a connection surface of the second support frame that is opposite to a surface of the second support frame that is mounted on the third support frame.

3. The cooling device according to claim 2, wherein the second support frame has a through opening through which the motor is exposed on the connection surface in a state where the second support frame is mounted on the third support frame.

4. The cooling device according to claim 3, wherein the through opening is provided adjacent to the second groove portion.

5. The cooling device according to claim 4, wherein the air duct formed by the first groove portion and the second groove portion includes a first air passage extending upward from the blowing port, and a second air passage extending horizontally from an upper end of the first air passage, and the through opening is provided below a portion of the second groove portion which portion forms the second air passage.

6. The cooling device according to claim 5, wherein the first support frame supports the air blower such that air is blown obliquely upward from the blowing port.

7. The cooling device according to claim 3, wherein the driving portion is provided adjacent to the second groove portion.

8. The cooling device according to claim 2, wherein the driving portion includes a transmission gear configured to transmit the driving force from the motor.

9. An image forming apparatus comprising the cooling device according to claim 1.

10. The image forming apparatus according to claim 9, further comprising:

a housing;

a mounting plate provided within the housing and extending in an up-down direction;

the cooling device mounted on a mounting surface of the mounting plate at one side;

an intermediate transfer belt provided in a housing space at a side opposite to the mounting surface of the mounting plate;

a control board provided in the housing space and disposed above the intermediate transfer belt; and an air guide provided on the mounting plate and configured to guide the air blown from the air duct of the cooling device, through a communication port formed in the mounting plate to a void between the intermediate transfer belt and the control board in the housing space.

11. The image forming apparatus according to claim 10, further comprising a waste toner cleaning portion provided in the void and configured to remove waste toner remaining on the intermediate transfer belt, wherein the air guide guides the air toward the waste toner cleaning portion.

* * * * *